US010900458B2

(12) United States Patent
Gopalakrishnan et al.

(10) Patent No.: US 10,900,458 B2
(45) Date of Patent: Jan. 26, 2021

(54) APPARATUS AND METHOD FOR CONTROL OF POWERTRAIN STOP POSITION

(71) Applicant: GM GLOBAL TECHNOLOGY OPERATIONS LLC, Detroit, MI (US)

(72) Inventors: Suresh Gopalakrishnan, Troy, MI (US); Paul S. Lombardo, Ferndale, MI (US); David W. Walters, Sterling Heights, MI (US); Chunhao J. Lee, Troy, MI (US); Chandra S. Namuduri, Troy, MI (US); Neeraj S. Shidore, Novi, MI (US); Thomas W. Nehl, Shelby Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/406,658

(22) Filed: May 8, 2019

(65) Prior Publication Data

US 2020/0355152 A1 Nov. 12, 2020

(51) Int. Cl.
*F02N 19/00* (2010.01)
*F02N 11/00* (2006.01)

(52) U.S. Cl.
CPC ..... *F02N 19/005* (2013.01); *F02N 11/00* (2013.01); *F02N 2019/008* (2013.01)

(58) Field of Classification Search
CPC ..... F02D 2041/0095; F02N 19/005; F02N 2019/008; F02N 2200/021; F02N 2200/022
USPC ..... 701/112; 123/179.4
See application file for complete search history.

(56) References Cited

U.S. PATENT DOCUMENTS

| | | | | |
|---|---|---|---|---|
| 9,261,043 | B2 * | 2/2016 | Teruya | F02D 45/00 |
| 10,151,261 | B2 * | 12/2018 | Yokoyama | F02D 41/042 |
| 10,351,122 | B2 * | 7/2019 | Fujimoto | F02N 19/005 |
| 2007/0233357 | A1 * | 10/2007 | Sugai | B60L 50/16 701/105 |
| 2014/0074333 | A1 * | 3/2014 | Ohkuma | F02D 29/02 701/22 |
| 2015/0329103 | A1 | 11/2015 | Kim et al. | |
| 2016/0017856 | A1 * | 1/2016 | Tsukada | B60W 10/08 701/112 |
| 2018/0142659 | A1 * | 5/2018 | Okamura | F02N 99/006 |
| 2019/0226440 | A1 * | 7/2019 | Murakami | F02N 11/04 |
| 2019/0242308 | A1 * | 8/2019 | Kees | F02N 19/005 |

* cited by examiner

*Primary Examiner* — Erick R Solis
(74) *Attorney, Agent, or Firm* — Cantor Colburn LLP

(57) ABSTRACT

A method of stopping an engine crankshaft includes selecting a target angular position at which the engine crankshaft is to be stopped and detecting an actual angular position of the engine crankshaft and a rotational speed of the engine crankshaft. A stopping torque in calculated based on the actual angular position of the engine crankshaft and the rotational speed of the engine crankshaft. The stopping torque is applied to the engine crankshaft via a motor/generator operably connected to the engine crankshaft. The engine crankshaft is stopped at the target angular position via the application of the stopping torque.

20 Claims, 3 Drawing Sheets

APPARATUS AND METHOD FOR CONTROL OF POWERTRAIN STOP POSITION

INTRODUCTION

The subject disclosure relates to powertrain systems for vehicles, and in particular to start/stop systems of powertrains. Powertrain systems for, for example, hybrid vehicles, include two sources of torque, typically an internal combustion engine and one or more electric motors which are operable in parallel or in series to provide torque to the wheels of a vehicle. During certain operational modes, the engine operation is ceased by turning the engine off. A powertrain control module may cause the engine to turn off during those certain operating conditions, and such an action is referred to as an "engine autostop". Similarly, in certain operating conditions, it is desired to start operation of the engine, to provide torque in addition to or instead of the torque provided by the electric motors. Such an event is referred to as an "engine autostart".

In a conventional system, when an engine autostop occurs the engine stops at a random stop position. It is desired, however, for a smooth and consistent autostart that the engine starting position be just a few degrees before an engine top dead center position. Top dead center, sometimes referred to as TDC, is the point in which the position of the piston of one of the cylinders of the engine is close to its highest point on the compression stroke.

SUMMARY

In one embodiment, a method of stopping an engine crankshaft includes selecting a target angular position at which the engine crankshaft is to be stopped, detecting an actual angular position of the engine crankshaft and a rotational speed of the engine crankshaft, calculating a stopping torque based on the actual angular position of the engine crankshaft and the rotational speed of the engine crankshaft, applying the stopping torque to the engine crankshaft via a motor/generator operably connected to the engine crankshaft, and stopping the engine crankshaft at the target angular position via the application of the stopping torque.

Additionally or alternatively, in this or other embodiments the motor/generator is configured as a belt/alternator/starter motor/generator.

Additionally or alternatively, in this or other embodiments the actual angular position of the engine crankshaft is detected via one or more position sensors disposed at the engine crankshaft.

Additionally or alternatively, in this or other embodiments the actual angular position of the engine crankshaft is calculated utilizing the rotational speed of the engine crankshaft.

Additionally or alternatively, in this or other embodiments the actual angular position of the engine crankshaft is compared to the target angular position, and the stopping torque is calculated based on a result of the comparison.

Additionally or alternatively, in this or other embodiments the target angular position is selected when the angular position of the engine crankshaft and the rotational speed of the engine crankshaft are both below respective thresholds.

Additionally or alternatively, in this or other embodiments the threshold of the rotational speed of the engine crankshaft is 750 rpm.

Additionally or alternatively, in this or other embodiments the threshold of the angular position of the engine crankshaft is 10 degrees from a top dead center position.

Additionally or alternatively, in this or other embodiments calculating the stopping torque is performed by an engine controller operably connected to the engine and the calculated stopping torque is transmitted to the motor-generator.

Additionally or alternatively, in this or other embodiments calculating the stopping torque is performed by a motor-generator controller operably connected to the motor-generator.

In another embodiment powertrain of a vehicle includes an engine having a crankshaft and configured to output torque, a motor/generator operably connected to the engine, and a controller operably connected to the motor/generator. The controller is configured to determine a target angular position at which the engine crankshaft is to be stopped, detect an actual angular position of the engine crankshaft and a rotational speed of the engine crankshaft, calculate a stopping torque based on the actual angular position of the engine crankshaft and the rotational speed of the engine crankshaft, command the motor/generator to apply the stopping torque to the engine crankshaft, and stop the engine crankshaft at the target angular position via the application of the stopping torque.

Additionally or alternatively, in this or other embodiments the motor/generator is configured as a belt/alternator/starter motor/generator.

Additionally or alternatively, in this or other embodiments one or more position sensors are positioned at the engine crankshaft and operably connected to the controller to detect the actual angular position of the engine crankshaft.

Additionally or alternatively, in this or other embodiments the controller is configured to compute the actual angular position of the engine crankshaft utilizing the rotational speed of the engine crankshaft.

Additionally or alternatively, in this or other embodiments the controller is an engine controller operably connected to the engine and the calculated stopping torque is transmitted to the motor-generator.

Additionally or alternatively, in this or other embodiments the controller is a motor-generator controller operably connected to the motor-generator.

In yet another embodiment, a vehicle includes one or more wheels, an engine having a crankshaft and configured to output torque to the one or more wheels, a motor/generator operably connected to the engine, and a controller operably connected to the motor/generator. The controller is configured to determine a target angular position at which the engine crankshaft is to be stopped, detect an actual angular position of the engine crankshaft and a rotational speed of the engine crankshaft, calculate a stopping torque based on the actual angular position of the engine crankshaft and the rotational speed of the engine crankshaft, command the motor/generator to apply the stopping torque to the engine crankshaft, and stop the engine crankshaft at the target angular position via the application of the stopping torque.

Additionally or alternatively, in this or other embodiments the motor/generator is configured as a belt/alternator/starter motor/generator.

Additionally or alternatively, in this or other embodiments one or more position sensors are located at the engine crankshaft and are operably connected to the controller to detect the actual angular position of the engine crankshaft.

Additionally or alternatively, in this or other embodiments the controller is one of an engine controller operably connected to the engine or a motor-generator controller operably connected to the motor-generator.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
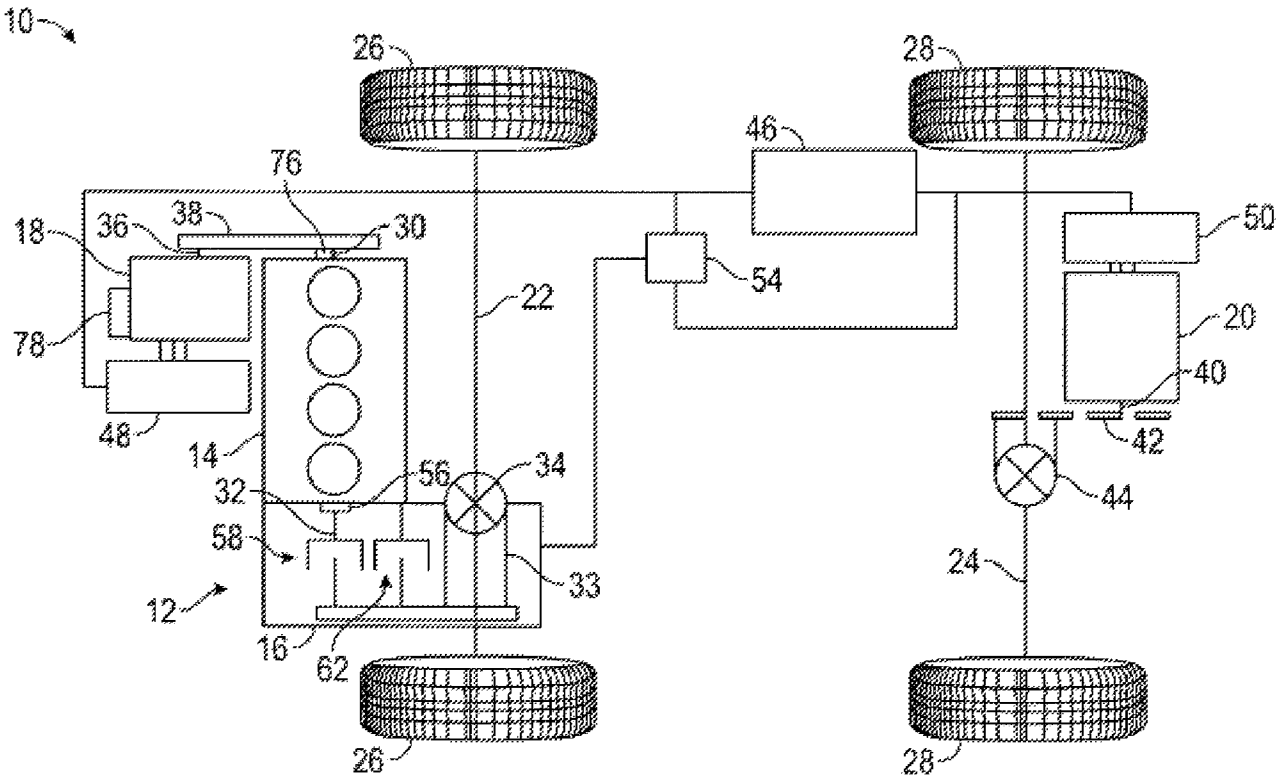
FIG. 1 is a schematic illustration of an embodiment of a vehicle.

The following description is merely exemplary in nature and is not intended to limit the present disclosure, its application or uses. It should be understood that throughout the drawings, corresponding reference numerals indicate like or corresponding parts and features.

In accordance with an exemplary embodiment, a vehicle 10 is illustrated in FIG. 1. The vehicle 10 includes a powertrain 12 having an internal combustion engine 14, a transmission 16, a first electric motor/generator unit (MGU) 18, and a second electric motor/generator unit (MGU) 20. In some embodiments, the first MGU 18 has a belt/alternator/starter (BAS) configuration. The vehicle 10 further includes a front (first) axle 22 and a rear (second) axle 24. Two front wheels 26 are operatively connected to the front axle 22 and rotate with the front axle 22. Similarly, two rear wheels 28 are operatively connected to the rear axle 24 and rotate with the rear axle 24.

The engine 14 includes a crankshaft 30 that is operatively connected to an input member 32 of the transmission 16 to transmit torque thereto. The transmission 16 includes an output member 33 operatively connected to the front wheels 26 via the front differential 34 and the front axle 22.

The first MGU 18 includes a first rotor 36 that is connected to the crankshaft 30 via a torque transfer device 38, such as a belt drive, chain drive, or gears, and thus the first MGU 18 is configured to selectably transfer torque or apply torque to the crankshaft 30. The second MGU 20 includes a second rotor 40 that is operatively connected to a rear differential 44 to transmit or apply torque thereto via gears 42. The rear differential 44 operatively connects the rear axle 24 to the second rotor 44 such that torque is transmissible from the second rotor 40 to the rear wheels 28 via the rear axle 24. It is to be appreciated that the first MGU 18 and second MGU 20 arrangement illustrated in FIG. 1 is merely exemplary, and that other configurations are contemplated within the present scope. For example, in some embodiments, both the first MGU 18 and the second MGU 20 may be connected to the crankshaft 30, and other quantities of MGU's, for example, one or two MGUs. In other embodiments, only the first MGU 18 is utilized and connected to the crankshaft as described above. In still other embodiments, the crankshaft 30 may be operatively connected to both the front axle 22 and to the rear axle 24.

An electrical energy storage device, such as a battery 46, is operatively connected to the first MGU 18 via a first inverter 48, and is similarly connected to the second MGU 20 via a second inverter 50. A powertrain controller 54 is connected to the first MGU 18 and the second MGU 20, to the engine 14, and to the transmission 16. The powertrain controller 54 is configured to control the operation of the engine 14 and to control the torque output of the first MGU 18 and the second MGU 20. Further, the powertrain controller 54 controls engagement and disengagement of the various clutches and brakes, schematically shown at 56, 58 and 62, of the transmission 16 to thereby control a rotational speed ratio between the input member 32 and the output member 33.

It should be noted that, as used herein, a "controller" may include one or more control units that cooperate to perform the operations described herein. For example, the powertrain controller 54 may be a single powertrain control unit, or powertrain controller 54 may include a transmission control module and an engine control module that are separate but cooperate to perform the operations described herein.

During certain modes of operation, the engine 14 is turned off, when the vehicle is coasting down to zero speed. Such an action by the controller 54 is referred to as "engine autostop". Similarly, in certain operating conditions, it may be desired to additionally or alternatively use the engine 14 to provide torque. In those operating conditions, the engine 14 is commanded to restart by the controller 54, and such operation is referred to as an "engine autostart". For the engine autostart, it is desired to have the engine crankshaft 30 at a selected position, a few degrees before the top dead center position, or the point in which the piston of one of the cylinders of the engine 14 is close to the highest point on the compression stroke. In some embodiments, the selected position is a calibratable angle in the range of, for example, 30 degrees to 60 degrees before top dead center position. Such an engine crankshaft 30 start position allows for smooth engine autostarts and improves noise, vibration and harshness (NVH) performance. The selection of the optimum angle to stop the engine depends on the characteristics of the vehicle, number of cylinders, etc.

Figure 2:
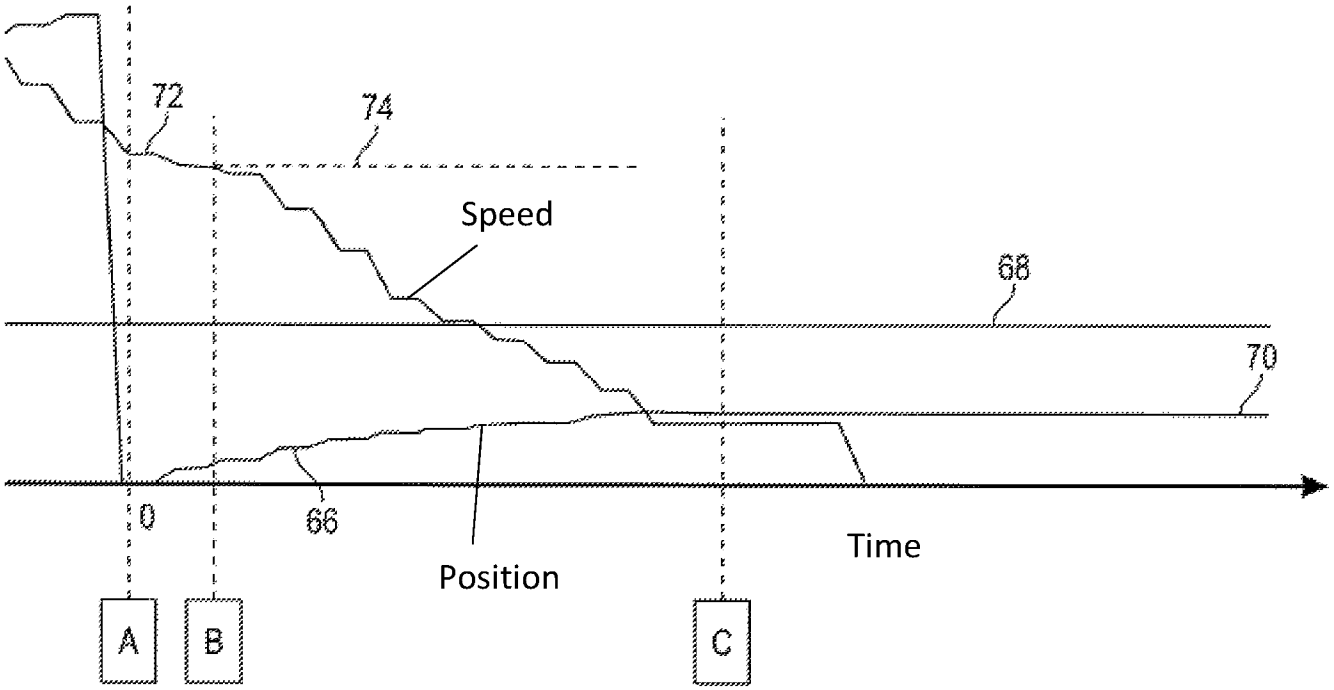
FIG. 2 is a graphical schematic of an engine autostop sequence with crankshaft stop position control.

Referring now to FIG. 2, shown is a schematic illustration of an engine autostop sequence, to stop the engine crankshaft 30 at a selected position. At location A, the crankshaft rotational position 66 is below a threshold position 68, for example 10 degrees from a target angular position 70, and an engine rotational speed 72 is at a first threshold speed 74, for example 250 rpm. When the engine rotational speed 72 falls below the first threshold speed 74, the crankshaft angular position 66 is monitored by, for example, one or more position sensors 76 (shown in FIG. 1). Alternatively, if a crankshaft position signal is not available, an engine speed signal may be integrated to provide the crankshaft angular position 66. Once the target angular position 70 is reached, a torque is applied to the crankshaft 30 by, for example, one of motor/generators 18, 20, to stop rotation of the crankshaft 30 such that the crankshaft angular position 66 equals the target angular position 70.

Figure 3:
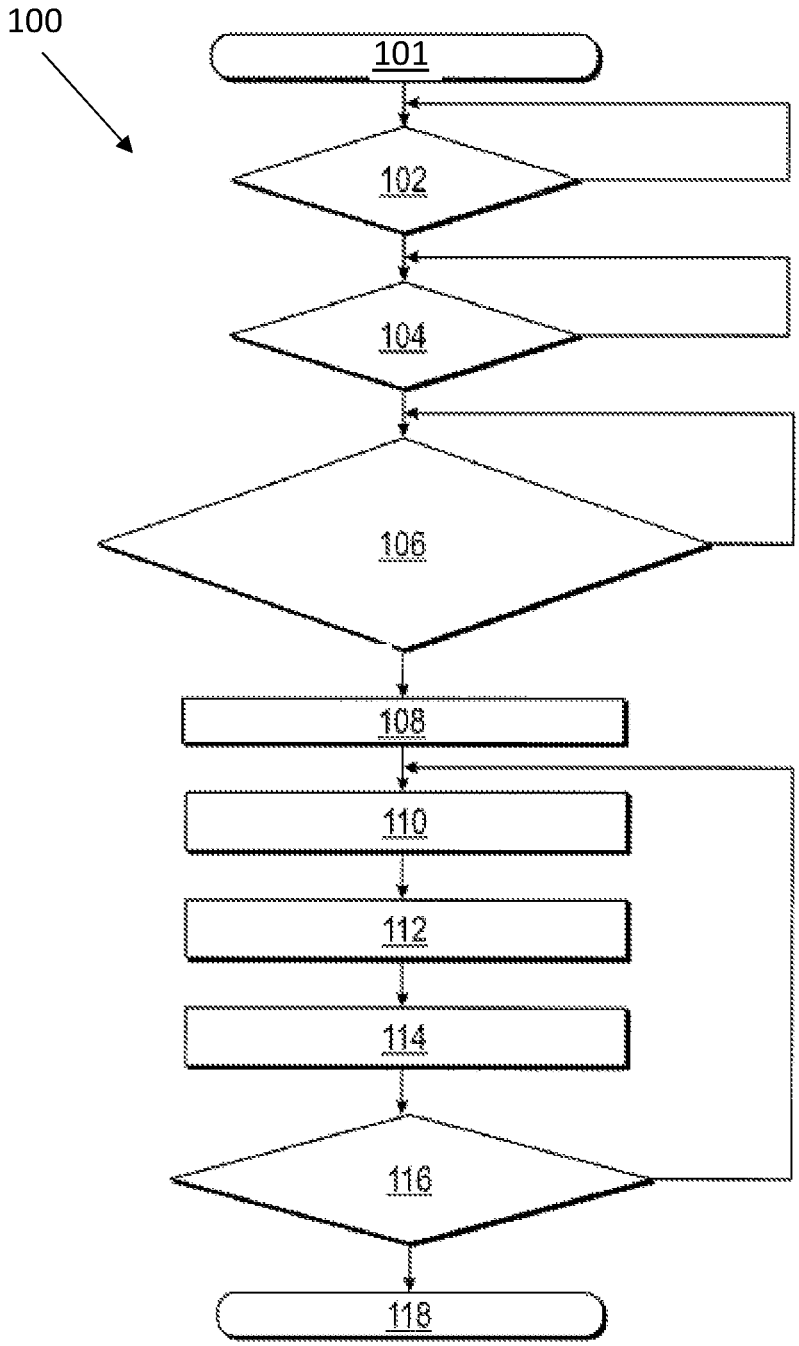
FIG. 3 is a schematic illustration of a method of stopping an engine with crankshaft stop position control.

Referring now to FIG. 3, a method 100 of control of the crankshaft angular position 66 during an engine autostop event will be described further. At block 101 the controller 54 signals for an autostop event to begin. Such a signal causes the engine 14 to initiate an autostop sequence. The status of the autostop initiation is monitored at block 102. If the autostop sequence is initiated the method proceeds to block 104. If on the other hand, the autostop is not initiated the method returns to block 102. At block 104 a fuel flow to the engine 14 is stopped monitored. If the fuel flow is successfully stopped, the method proceed to block 106, and if not returns to block 104 to monitor the fuel flow. At block 106, the crankshaft angular position 66 and the engine rotational speed are monitored. When both the engine rotational speed and the crankshaft angular position 66 are below respective thresholds, a target angular position 70 is set at block 108. If not below the threshold, the method returns to block 106 for monitoring of the crankshaft angular position and engine rotational speed. For example, in some embodiments, and engine rotational speed threshold is in the range of 600 to 900 rpm, for example 750 rpm, and the threshold crankshaft angular position is between 5 and 15 degrees, for example, 10 degrees from top dead center.

At block 110, the crankshaft angular position continues to be monitored, in some embodiments by integrating the engine rotational speed with respect to time. At block 112, the actual crankshaft angular position is compared to the target angular position 70 to arrive at a crankshaft angular positon error. A stopping torque command is calculated at block 114 and is applied to the crankshaft 30 to stop the crankshaft 30 at the target angular position 70. If the target angular position 70 is reached at block 116, the autostop sequence is ended at block 118. If the target angular position 70 is not reached, the method returns to block 110. In some embodiments, the position control described above is performed by the engine controller 54, which using the target angular position 70 transmits the stopping torque command to one of motor/generators 18, 20. In other embodiments, a motor-generator controller 72 (shown in FIG. 1) utilizes the target angular position 70 and sensed engine rotational speed and/or crankshaft angular position 66 data to generate an optimal stopping torque to reach the target angular position 70.

The above described structures and methods provide control of the autostop of the engine 14 such that the crankshaft 30 is stopped at a selected angular position to improve NVH performance and to smooth engine 14 autostarts.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof

What is claimed is:

1. A method of stopping an engine crankshaft, comprising:

selecting a target angular position at which the engine crankshaft is to be stopped;

detecting an actual angular position of the engine crankshaft and a rotational speed of the engine crankshaft;

calculating a stopping torque based on the actual angular position of the engine crankshaft and the rotational speed of the engine crankshaft;

apply the stopping torque to the engine crankshaft when the engine crankshaft reaches the target angular position, the stopping torque applied via a motor/generator operably connected to the engine crankshaft; and stopping the engine crankshaft at the target angular position via the application of the stopping torque.

2. The method of claim 1, wherein the motor/generator is configured as a belt/alternator/starter motor/generator.

3. The method of claim 1, further comprising detecting the actual angular position of the engine crankshaft via one or more position sensors disposed at the engine crankshaft.

4. The method of claim 1, further comprising computing the actual angular position of the engine crankshaft utilizing the rotational speed of the engine crankshaft.

5. The method of claim 1, further comprising:

comparing the actual angular position of the engine crankshaft to the target angular position; and calculating the stopping torque based on a result of the comparison.

6. The method of claim 1, further comprising selecting the target angular position when the angular position of the engine crankshaft and the rotational speed of the engine crankshaft are both below respective thresholds.

7. The method of claim 6, wherein the threshold of the rotational speed of the engine crankshaft is 750 rpm.

8. The method of claim 6, wherein the threshold of the angular position of the engine crankshaft is 10 degrees from a top dead center position.

9. The method of claim 1, wherein calculating the stopping torque is performed by an engine controller operably connected to the engine and the calculated stopping torque is transmitted to the motor-generator.

10. The method of claim 1, wherein calculating the stopping torque is performed by a motor-generator controller operably connected to the motor-generator.

11. A powertrain of a vehicle, comprising:

an engine having a crankshaft and configured to output torque;

a motor/generator operably connected to the engine; and a controller operably connected to the motor/generator configured to:

determine a target angular position at which the engine crankshaft is to be stopped;

detect an actual angular position of the engine crankshaft and a rotational speed of the engine crankshaft;

calculate a stopping torque based on the actual angular position of the engine crankshaft and the rotational speed of the engine crankshaft;

command the motor/generator to apply the stopping torque to the engine crankshaft when the engine crankshaft reaches the target angular position; and stop the engine crankshaft at the target angular position via the application of the stopping torque.

12. The powertrain of claim 11, wherein the motor/generator is configured as a belt/alternator/starter motor/generator.

13. The powertrain of claim 11, further comprising one or more position sensors disposed at the engine crankshaft and operably connected to the controller to detect the actual angular position of the engine crankshaft.

14. The powertrain of claim 11, wherein the controller is configured to compute the actual angular position of the engine crankshaft utilizing the rotational speed of the engine crankshaft.

15. The powertrain of claim 11, wherein the controller is an engine controller operably connected to the engine and the calculated stopping torque is transmitted to the motor-generator.

16. The powertrain of claim 11, wherein the controller is a motor-generator controller operably connected to the motor-generator.

17. A vehicle, comprising:

one or more wheels;

an engine having a crankshaft and configured to output torque to the one or more wheels;

a motor/generator operably connected to the engine; and a controller operably connected to the motor/generator configured to:

determine a target angular position at which the engine crankshaft is to be stopped;

detect an actual angular position of the engine crankshaft and a rotational speed of the engine crankshaft;

calculate a stopping torque based on the actual angular position of the engine crankshaft and the rotational speed of the engine crankshaft;

command the motor/generator to apply the stopping torque to the engine crankshaft when the engine crankshaft reaches the target angular position, the stopping torque applied; and stop the engine crankshaft at the target angular position via the application of the stopping torque.

18. The vehicle of claim 17, wherein the motor/generator is configured as a belt/alternator/starter motor/generator.

19. The vehicle of claim 17, further comprising one or more position sensors disposed at the engine crankshaft and operably connected to the controller to detect the actual angular position of the engine crankshaft.

20. The vehicle of claim 17, wherein the controller is one of an engine controller operably connected to the engine or a motor-generator controller operably connected to the motor-generator.

* * * * *